US009957462B2

(12) United States Patent
Guerin et al.

(10) Patent No.: US 9,957,462 B2
(45) Date of Patent: May 1, 2018

(54) ENGINE LUBRICANT COMPOSITION

(71) Applicants: TOTAL MARKETING SERVICES, Puteaux (FR); DOW GLOBAL TECHNOLOGIES LLC, Midland, MI (US)

(72) Inventors: Julien Guerin, Lyons (FR); Nicholas Obrecht, Lyons (FR); Nadjet Khelidj, Horgen (CH)

(73) Assignees: Total Marketing Services, Puteaux (FR); Dow Global Technologies LLC, Midland, MI (US)

( * ) Notice: Subject to any disclaimer, the term of this patent is extended or adjusted under 35 U.S.C. 154(b) by 0 days. days.

(21) Appl. No.: 14/398,176

(22) PCT Filed: May 3, 2013

(86) PCT No.: PCT/EP2013/059254
§ 371 (c)(1),
(2) Date: Oct. 31, 2014

(87) PCT Pub. No.: WO2013/164449
PCT Pub. Date: Nov. 7, 2013

(65) Prior Publication Data

US 2015/0119303 A1 Apr. 30, 2015

(30) Foreign Application Priority Data

May 4, 2012 (FR) ..... 12 54152

(51) Int. Cl.

| | |
|---|---|
| ***C10M 161/00*** | (2006.01) |
| ***C10M 145/34*** | (2006.01) |
| ***C10M 145/00*** | (2006.01) |
| ***C10M 145/26*** | (2006.01) |
| ***C10M 145/32*** | (2006.01) |
| ***C10M 157/00*** | (2006.01) |

(52) U.S. Cl.
CPC ..... *C10M 161/00* (2013.01); *C10M 145/00* (2013.01); *C10M 145/26* (2013.01); *C10M 145/32* (2013.01); *C10M 145/34* (2013.01); *C10M 157/00* (2013.01); *C10M 2203/1025* (2013.01); *C10M 2205/02* (2013.01); *C10M 2205/022* (2013.01); *C10M 2205/028* (2013.01); *C10M 2205/04* (2013.01); *C10M 2207/026* (2013.01); *C10M 2207/262* (2013.01); *C10M 2207/289* (2013.01); *C10M 2209/084* (2013.01); *C10M 2209/105* (2013.01); *C10M 2209/106* (2013.01); *C10M 2215/064* (2013.01); *C10M 2215/28* (2013.01); *C10M 2219/068* (2013.01); *C10M 2223/045* (2013.01); *C10N 2230/02* (2013.01); *C10N 2230/04* (2013.01); *C10N 2230/54* (2013.01); *C10N 2240/102* (2013.01); *C10N 2240/103* (2013.01); *C10N 2240/104* (2013.01)

(58) Field of Classification Search
CPC ..... C10M 161/00; C10M 145/32; C10M 145/00; C10M 145/26; C10M 145/34; C10M 157/00; C10M 2203/1025; C10M 2205/02; C10M 2205/022; C10M 2205/028; C10M 2205/04; C10M 2207/026; C10M 2207/262; C10M 2207/289; C10M 2209/084; C10M 2209/105; C10M 2209/106; C10M 2215/064; C10M 2215/28; C10M 2219/068; C10N 2240/10; C10N 2230/02; C10N 2230/04; C10N 2230/54; C10N 2240/104
USPC ..... 508/287
See application file for complete search history.

(56) References Cited

U.S. PATENT DOCUMENTS

| | | | |
|---|---|---|---|
| 4,072,619 | A | 2/1978 | Williams et al. |
| 6,458,750 | B1 | 10/2002 | Dardin et al. |
| 7,662,881 | B2 | 2/2010 | Walton et al. |
| 8,357,644 | B2 | 1/2013 | Thoen et al. |
| 8,486,878 | B2 | 7/2013 | Li Pi Shan et al. |
| 8,492,322 | B2 | 7/2013 | Li Pi Shan et al. |
| 8,592,357 | B2 | 11/2013 | Thoen et al. |
| 8,609,597 | B2 | 12/2013 | Greaves et al. |

(Continued)

FOREIGN PATENT DOCUMENTS

| | | | |
|---|---|---|---|
| CA | 2034144 | A1 | 7/1991 |
| WO | WO-2009134716 | A1 | 11/2009 |

(Continued)

OTHER PUBLICATIONS

"UCON™ OSP Base Fluids" Brochure, DOW, XP055034465, Feb. 28, 2011; 4 pages.

*Primary Examiner* — James Goloboy
(74) *Attorney, Agent, or Firm* — Harness, Dickey & Pierce, PLC

(57) ABSTRACT

The present disclosure concerns engine lubricant compositions including at least one base oil, at least one viscosity index improver polymer and at least one polyalkylene glycol, obtained by polymerization or copolymerization of alkylene oxides comprising from 3 to 8 carbon atoms, including at least one butylene oxide, the quantity of polyalkylene glycol being from 1 to 28% by mass with respect to the total mass of lubricant composition. Using at least one polyalkylene glycol, obtained by polymerization or copolymerization of alkylene oxides including from 3 to 8 carbon atoms, further including at least one butylene oxide in a base oil improves engine cleanliness while not increasing, or indeed while decreasing, the consumption of petrol or diesel fuels by the engine.

5 Claims, No Drawings

(56) References Cited

U.S. PATENT DOCUMENTS

| | | | | |
|---|---|---|---|---|
| 2005/0107269 | A1* | 5/2005 | Yagishita | C10M 141/10<br>508/440 |
| 2012/0108482 | A1 | 5/2012 | Greaves et al. | |
| 2013/0157909 | A1 | 6/2013 | Greaves et al. | |
| 2013/0244917 | A1 | 9/2013 | Obrecht et al. | |
| 2014/0018272 | A1 | 1/2014 | Thoea et al. | |
| 2014/0018273 | A1 | 1/2014 | Zweifel et al. | |

FOREIGN PATENT DOCUMENTS

| | | | | |
|---|---|---|---|---|
| WO | WO-2011/011656 | A2 | 1/2011 | |
| WO | WO 2011011656 | A2 * | 1/2011 | C10M 107/34 |
| WO | WO 2012030537 | A1 * | 3/2012 | C10M 169/04 |
| WO | WO-2012/070007 | A1 | 5/2012 | |

* cited by examiner

ENGINE LUBRICANT COMPOSITION

CROSS-REFERENCE TO RELATED APPLICATIONS

This application is a National Phase Entry of International Application No. PCT/EP2013/059254, filed on May 3, 2013, which claims priority to French Patent Application Serial No. 1254152, filed on May 4, 2012, both of which are incorporated by reference herein.

TECHNICAL FIELD

The present invention relates to lubricant compositions for engines, in particular for engines of gasoline vehicles or diesel vehicles, the use of which makes it possible to simultaneously obtain satisfactory engine cleanliness and a reduction in the fuel consumption of said vehicles.

BACKGROUND

Energy efficiency and reducing the fuel consumption of motor vehicle engines is a growing concern. It is known that lubricants for engines used in said vehicles play an important role in this regard.

In order to formulate "Fuel Eco" lubricants or fuel economy lubricants, it is known to act on the viscosity of the lubricant bases used. It is also known to use viscosity index (VI) improver polymers, or to use friction modifiers (FM). However, the viscosity index improver polymers have the drawback of reducing the engine cleaning power of the lubricant compositions in which they are used. Existing engines have high thermal stresses which result in significant deposit phenomena. The deposits are linked to the chemical conversion of the lubricant in the parts that are closest to the combustion chamber and therefore the hottest.

A need therefore exists to have lubricant compositions comprising at least one viscosity index improver polymer which provide good engine cleanliness and which make it possible to limit the fuel consumption of gasoline vehicles or diesel vehicles. An objective of the present invention is the use of new additive compounds in a lubricant composition making it possible to formulate a lubricant composition having good properties in terms of engine cleanliness. This objective is achieved by means of the use of at least one polyalkylene glycol, obtained by polymerization or copolymerization of alkylene oxides comprising from 3 to 8 carbon atoms, including at least one butylene oxide in a lubricant composition. Surprisingly, the Applicant company has found that the use of these polyalkylene glycols as additives advantageously makes it possible to obtain a lubricant composition having good properties as regards engine cleanliness.

Another objective of the present invention is the formulation of a lubricant composition simultaneously having good engine cleanliness properties and good "Fuel Eco" properties. This objective is achieved by means of a lubricant composition for engines, in particular gasoline engines or diesel engines, comprising a specific combination of a polyalkylene glycol obtained by polymerization or copolymerization of alkylene oxides, including at least one butylene oxide and at least one viscosity index improver polymer.

Such propylene oxide and butylene oxide copolymers are known from the document WO2011/011656. These propylene oxide and butylene oxide copolymers have the property of being soluble in the base oils of Groups I to IV used in the formulation of the lubricants.

The document U.S. Pat. No. 6,458,750 describes an engine oil composition with reduced deposit-formation tendency, said composition comprising at least one base oil and at least one alkyl alkoxylate of formula (I):

$$R_1\text{-}(CR_2R_3)_n\text{-}_zL\text{-}A\text{-}R_4 \quad (I)$$

wherein $R_1$, $R_2$, $R_3$ represents independently one hydrogen atom or a hydrocarbon group containing up to 40 carbon atoms, $R_4$ is a hydrogen atom or a methyl group or an ethyl group, L is a linker group, n is an integer ranging from 4 to 40, A is an alkoxy group with 2 to 25 repeating units, which are derived from ethylene oxide, propylene oxide and/or butylene oxide and comprising homopolymers as well as statistical copolymers of at least two of the said compounds, and z is 1 or 2.

However, this document does not disclose a lubricant composition comprising at least one polyalkylene glycol which is a copolymer of butylene oxide and propylene oxide in which the butylene oxide to propylene oxide mass ratio is selected from the range of values of the present invention. In addition, this document does not describe the use of a specific polyalkylene glycol for improving the engine cleanliness, without increasing the consumption of gasoline or diesel fuel.

The document EP0438709 discloses an engine oil comprising at least one base oil, at least one polymeric viscosity index improver and at least one product resulting from the reaction of phenols or bisphenol A with at least one butylene oxide or a butylene/propylene oxide for improving piston cleanliness of automobile engines. However, this document does not disclose the lubricating compositions according to the invention. Nor does it disclose the use of polyalkylene glycol as defined by the invention in a lubricant composition in order to improve engine cleanliness and reduce fuel consumption. In order to simultaneously obtain good "Fuel Eco" and cleaning properties, the quantity of polyalkylene glycol in the lubricant composition must be limited to between 1 and 30% by mass with respect to the total mass of the lubricant composition, the 30% upper limit being excluded.

SUMMARY

The invention relates to a lubricant composition for engines comprising at least one base oil, at least one viscosity index improver polymer and at least one polyalkylene glycol, obtained by polymerization or copolymerization of alkylene oxides comprising from 3 to 8 carbon atoms, including at least one butylene oxide, the quantity of polyalkylene glycol being from 1 to 28% by mass with respect to the total mass of lubricant composition. Preferably, the polyalkylene glycol is a copolymer of butylene oxide and propylene oxide. Preferably, the butylene oxide to propylene oxide mass ratio is a value of 3:1 to 1:3, preferably a value of 3:1 to 1:1.

Preferably, the polyalkylene glycol has a molar mass measured according to the standard ASTM D4274 ranging from 300 to 1000 grams per mole, preferably from 500 to 750 grams per mole. Preferably, the polyalkylene glycol has a kinematic viscosity at 100° C. measured according to the standard ASTM D445 ranging from 1 to 12 cSt, preferably from 3 to 7 cSt, more preferably from 3.5 to 6.5 cSt. Preferably, the lubricant composition comprises from 2 to 20% by mass of polyalkylene glycol with respect to the total mass of the lubricant composition, preferably from 3 to 15%, more preferably from 5 to 12%, even more preferably from 6 to 10%.

Preferably, the viscosity index improver polymer is chosen from the group consisting of the olefin copolymers, the ethylene/alpha-olefin copolymers, styrene/olefin copolymers, the polyacrylates alone or in a mixture. Preferably, the lubricant composition comprises from 1 to 15% by mass of viscosity index improver polymer with respect to the total mass of the lubricant composition, preferably from 2 to 10%, more preferably from 3 to 8%. Preferably, the lubricant composition also includes at least one additive chosen from anti-wear additives, detergents, dispersants, anti-oxidants, friction modifiers alone or in a mixture.

In one embodiment, the lubricant composition consists of:

from 40 to 80% by mass of base oil, from 1 to 28% by mass of polyalkylene glycol, obtained by polymerization or copolymerization of alkylene oxides comprising from 3 to 8 carbon atoms, including at least one butylene oxide, from 1 to 15% by mass of viscosity index improver polymer, from 1 to 15% by mass of additives chosen from the anti-wear additives, detergents, dispersants, anti-oxidants, friction modifiers alone or in a mixture, the sum of the constituents being equal to 100% and the percentage being expressed with respect to the total mass of lubricant composition.

The invention also concerns the use of a lubricant composition as defined above for the lubrication of a light or heavy vehicle engine, preferably of light gasoline or diesel vehicles. The invention also concerns the use of at least one polyalkylene glycol, obtained by polymerization or copolymerization of alkylene oxides comprising from 3 to 8 carbon atoms, including at least one butylene oxide in a lubricating composition in order to improve engine cleanliness, without increasing the consumption of gasoline or diesel fuel, preferably in order to improve engine cleanliness by reducing the consumption of gasoline or diesel fuel. Preferably, this use is aimed at improving engine cleanliness, in particular the cleanliness of the pistons. Another subject of the invention is a method for lubricating at least one mechanical part of an engine, said method comprising at least one step in which said mechanical part is brought into contact with at least one lubricant composition as defined above.

By improving engine cleanliness is meant within the meaning of the present invention reduction in formation of deposits, notably the formation of deposits at high temperatures such as glazes, lacquers or carbon deposits, coke deposits which form on the hot surfaces of engine parts such as the bottoms of piston ring grooves or turbocharger shaft. Molecules of lubricant compositions can become oxidized upon contact with hot surfaces of the engine and lead to the formation of insoluble products, forming deposits. These deposits will clog up the engine and lead to problems of wear, seizure, gumming of piston rings, and problems with turbocharger rotation, for example. Generally, detergent-type additives are employed for improving engine cleanliness. The Applicant company proposes using another type of additives for improving engine cleanliness. The lubricating composition according to the invention makes it possible to resolve problems of engine cleanliness, notably the above formation of deposits.

DETAILED DESCRIPTION

Polyalkylene Glycol Bases

The polyalkylene glycols used in the compositions according to the invention have properties suitable for use in an engine oil. These are (random or block) alkylene oxide polymers or copolymers which can be prepared according to the known methods described in the application WO 2009/134716, page 2 line 26 to page 4 line 12, for example by attack by an alcohol initiator on the epoxy bond of an alkylene oxide and propagation of the reaction.

The polyalkylene glycols (PAGs) of the compositions according to the invention correspond to general formula (A):

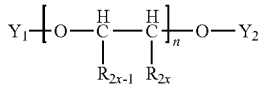

(A)

wherein $Y_1$ and $Y_2$ are, independently of each other, hydrogen, or a hydrocarbon group, for example an alkyl or alkylphenyl group, having 1 to 30 carbon atoms, n represents an integer greater than or equal to 2, preferably less than 60, preferably ranging from 5 to 30, preferably ranging from 7 to 15, x represents one or more integers ranging from 1 to n, the $R_{2x-1}$ and $R_{2x}$ groups are, independently of each other, hydrogen, or hydrocarbon radicals, comprising from 1 to 6 carbon atoms, preferably alkyl groups.

$R_{2x-1}$ and $R_{2x}$ are preferably linear.

Preferably at least one of $R_{2x-1}$ and $R_{2x}$ is hydrogen.

$R_{2x}$ is preferentially hydrogen.

The sum of the numbers of carbon atoms of $R_{2x-1}$ and $R_{2x}$ is of a value ranging from 1 to 6.

For at least one value of x, the sum of the numbers of carbon atoms in $R_{2x-1}$ and $R_{2x}$ is equal to 2. The corresponding alkylene oxide monomer is butylene oxide.

The alkylene oxides used for the PAGs of the compositions according to the invention comprise from 3 to 8 carbon atoms. At least one of the alkylene oxides entering into the structure of these PAGs is a butylene oxide, said butylene oxide being 1,2-butylene oxide or 2,3-butylene oxide, preferably 1,2-butylene oxide. In fact, the PAGs obtained, in part or in whole, from ethylene oxide do not have a sufficiently lipophilic nature to be used in engine oil formulae. In particular, they cannot be used in combination with other mineral, synthetic or natural base oils.

Neither is the use of alkylene oxides comprising more than 8 carbon atoms desired as, in order to produce bases having the molar mass and therefore the targeted viscosimetric grade for engine applications, there will then be a reduced number of monomers (low n in formula (A) above), with long $R_{2x-1}$ and $R_{2x}$ side chains. This is detrimental to the overall linear nature of the PAG molecule and leads to viscosity indices (VI) too low for an engine oil application.

Advantageously, the polyalkylene glycol may be a copolymer of butylene oxide and propylene oxide with the butylene oxide to propylene oxide mass ratio being a value of 3:1 to 1:3, preferably between 3:1 to 1:1, the polyalkylene glycol having the general formula (A):

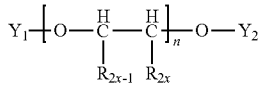

(A)

wherein and $Y_2$ are, independently of each other, hydrogen, or an alkyl group having 1 to 30 carbon atoms, n represents an integer greater than or equal to 2, preferably less than 60, preferably ranging from 5 to 30, preferably ranging from 7 to 15, x represents one or more integers ranging from 1 to n, the $R_{2x-1}$ and $R_{2x}$ groups are, independently of each other, hydrogen, or hydrocarbon radicals, comprising from 1 to 2 carbon atoms, for at least one value of x, the sum of the numbers of carbon atoms in $R_{2x-1}$ and $R_{2x}$ is equal to 2.

Preferably, the viscosity index VI (measured according to the standard NFT 60136) of the PAGs according to the invention is greater than or equal to 100, preferably greater than or equal to 120. In order to confer a sufficiently lipophilic nature upon them, and therefore a good solubility in synthetic base oils, mineral or natural base oils, and good compatibility with certain additives essential to the engine oils, the PAGs according to the invention are obtained from alkylene oxides comprising at least one butylene oxide. Among these PAGs, the butylene oxide (BO) and propylene oxide (PO) copolymers are particularly preferred, as they have both the good tribological and rheological properties of PAGs containing ethylene oxide units and/or polypropylene, and a good solubility in standard mineral, synthetic, and natural bases, and other oily compounds.

The application WO2011/011656, paragraphs [011] to [014] describes the method of preparation, characteristics, and properties (in particular solubility and miscibility in base oils) of such butylene oxide and propylene oxide copolymer PAGs. These PAGs are prepared by reaction of one or more alcohols with a mixture of butylene oxide and propylene oxide.

In order to confer upon the PAGs a good solubility and good miscibility in mineral, synthetic and natural base oils, it is preferred to use, in the compositions according to the invention, PAGs prepared with a mixture of butylene oxide and propylene oxide where the mass ratio of butylene oxide to propylene oxide is a value of 3:1 to 1:3. The PAGs prepared with a mixture where this ratio is a value of 3:1 to 1:1 are particularly miscible and soluble in base oils, including synthetic oils of Group IV (polyalphaolefins).

According to a preferred embodiment, the PAGs of the compositions according to the invention are prepared from alcohol comprising from 8 to 12 carbon atoms. 2-ethylhexanol and dodecanol, alone or in a mixture, and in particular dodecanol, are particularly preferred, as the PAGs prepared from these alcohols have very low traction coefficients. According to a preferred embodiment, the PAGs according to the invention are such that their carbon to oxygen molar ratio is greater than 3:1, preferably ranging from 3:1 to 6:1. This confers upon said PAGs polarity and viscosity index properties particularly suitable for use in engine oil.

The molar mass, measured according to the standard ASTM D2502, of the PAGs according to the invention has preferably a value ranging from 300 to 1000 grams per mole (g/mol), preferably ranging from 350 to 600 g/mol (this is why they contain a limited number of alkylene oxide units n as described above in formula (A)). The molar mass of the PAGs according to the invention measured according to the standard ASTM D4274 preferably has a value ranging from 300 to 1000 grams per mole (g/mol), preferably from 500 to 750 grams per mole.

This confers upon them kinematic viscosities at 100° C. (KV100) ranging generally from 1 to 12 cSt at 100° C., preferably from 3 to 7 cSt, preferably from 3.5 to 6.5 cSt, or from 4 to 6 cSt or from 3.5 to 4.5 cSt. The KV100 of the compositions is measured according to the standard ASTM D445. The use of light PAGs (KV100 approximately from 2 to 6.5 cSt) are preferably chosen in order to be able to more easily formulate multigrade oils of low temperature grade 5W or 0W according to the SAEJ300 classification, as the heavier PAGs have low-temperature properties (high CCS) which do not make it possible to easily achieve these grades.

Lubricant Composition

Another subject of the invention is a lubricant composition for engines, in particular for gasoline engines or for diesel engines, comprising at least one base oil, at least one viscosity index improver polymer and at least one polyalkylene glycol as defined previously, the quantity of polyalkylene glycol being from 1 to 28% by mass, with respect to the total mass of lubricant composition. A quantity less than 1% by mass is insufficient to obtain a significant effect in terms of fuel savings and engine cleanliness. Similarly, a quantity greater than or equal to 30% does not make it possible to obtain a significant effect in terms of engine cleanliness and fuel savings. Starting from 30% by mass, the "Fuel Eco" effects are less marked, or even reduced. Preferably, the lubricant compositions according to the invention comprise from 2 to 20% by mass of the polyalkylene glycols described above with respect to the total mass of lubricant composition, more preferably from 3 to 15%, even more preferably from 5 to 12%, even more preferably from 6 to 10%, with an optimum of around 8% by mass in terms of Fuel Eco properties and engine cleanliness.

Advantageously, the lubricant composition according to the invention may consist of:

from 40 to 80% by mass of base oil, from 1 to 28% by mass of polyalkylene glycol, which is a copolymer of butylene oxide and propylene oxide with the butylene oxide to propylene oxide mass ratio being a value of 3:1 to 1:3, preferably a value of 3:1 to 1:1, the polyalkylene glycol having the general formula (A):

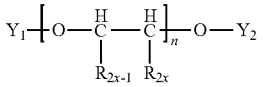

(A)

wherein $Y_1$ and $Y_2$ are, independently of each other, hydrogen, or an alkyl group having 1 to 30 carbon atoms, n represents an integer greater than or equal to 2, preferably less than 60, preferably ranging from 5 to 30, preferably ranging from 7 to 15, x represents one or more integers ranging from 1 to n, the $R_{2x-1}$ and $R_{2x}$ groups are, independently of each other, hydrogen, or hydrocarbon radicals, comprising from 1 to 2 carbon atoms, for at least one value of x, the sum of the numbers of carbon atoms in $R_{2x-1}$ and $R_{2x}$ is equal to 2, from 1 to 15% by mass of viscosity index improver polymer, from 1 to 15% by mass of additives chosen from the anti-wear additives, detergents, dispersants, anti-oxidants, friction modifiers alone or in a mixture, the sum of the constituents being equal to 100% and the percentage being expressed with respect to the total mass of lubricant composition.

Viscosity Index Improver Polymers

The polymers used in the compositions according to the present invention are viscosity index improver polymers. These polymers are polymers well known to a person skilled in the art and are chosen from the group constituted by the copolymers of ethylene and alpha-olefin, polyacrylates such as polymethacrylates, olefin copolymers (OCP), copolymers of ethylene, propylene and a diene (Ethylene Propylene Diene Monomers (EPDM)), polybutenes, copolymers of styrene and olefin, hydrogenated or not, copolymers of styrene and acrylate.

The olefin copolymers are preferably copolymers of ethylene and propylene. The quantity by mass of ethylene, with respect to the total mass of copolymer, varies from 20 to 80%, preferably from 30 to 70%, and is preferably situated around 50%.

The polyacrylates are preferably polymethacrylates, linear or comb-shaped, functionalized or non-functionalized. For the functionalized polymethacrylates, the term dispersant polymethacrylates is also used, also denoted PAMAd, which are polymethacrylates which are grafted or functionalized for example by vinyl pyrrolidone type units.

The copolymers of styrene and olefin are preferably copolymers of styrene and butadiene or copolymers of styrene and isoprene, hydrogenated or not, preferably hydrogenated, linear or star-shaped. Preferably, hydrogenated copolymers of styrene and isoprene are used. Preferably, hydrogenated copolymers of styrene and isoprene in a mixture with polymethacrylates (PMA) are used.

Preferably, the mass ratio of the hydrogenated copolymer of styrene and isoprene to the polymethacrylate varies from 3:1 to 1:3, and is preferably equal to 1:1. The lubricant compositions according to the invention comprise from 1 to 15% by mass of viscosity index improver polymer, or a mixture of viscosity index improver polymers, with respect to the total mass of lubricant composition, preferably from 2 to 10%, more preferably from 3 to 8%.

Base Oils

The lubricant compositions according to the present invention can comprise, in combination with the PAG as described above, one or more other base oils, which can be oils of mineral or synthetic origin of Groups I to V according to the classes defined in the API classification (or their equivalents according to the ATIEL classification) as summarized below, alone or in a mixture. Moreover, the base oil(s) used in the lubricant compositions according to the present invention can be chosen from the oils of synthetic origin of Group VI according to the ATIEL classification.

| | Saturates content | Sulphur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |

-continued

| | Saturates content | Sulphur content | Viscosity index (VI) |
|---|---|---|---|
| Group IV | Polyalphaolefins (PAO) | | |
| Group V | Esters and other bases not included in bases of Groups I to IV | | |
| Group VI* | (PIO) Poly Internal Olefins | | |

*for the ATIEL classification only

These oils can be oils of vegetable, animal, or mineral origin. The mineral base oils in the compositions according to the invention include all types of bases obtained by atmospheric and vacuum distillation of crude oil, followed by refining operations such as solvent extraction, deasphalting, solvent dewaxing, hydrotreating, hydrocracking and hydroisomerization, hydrofinishing.

The base oils in the compositions according to the present invention can also be synthetic oils, such as certain esters of carboxylic acids and alcohols, GTL bases which can be obtained by hydroisomerization of a Fisher-Tropsch wax, or polyalphaolefins. The polyalphaolefins used as base oils are for example obtained from monomers having 4 to 32 carbon atoms (for example octene, decene), and have a viscosity at 100° C. comprised between 1.5 and 15 cSt. Their average molecular mass by weight is typically comprised between 250 and 3000.

Preferably, the lubricant compositions according to the present invention have a kinematic viscosity at 100° C. comprised between 5.6 and 16.3 cSt measured by the standard ASTM D445, (SAE grade 20, 30 and 40), preferably comprised between 9.3 and 12.5 cSt (grade 30). According to a particularly preferred embodiment, the compositions according to the present invention are multigrade oils, of grade 5W or 0W according to the SAEJ300 classification. The compositions according to the present invention also preferably have a viscosity index (VI) greater than 130, preferably greater than 150, preferably greater than 160 (measured according to the standard ASTM D2270). The lubricant compositions according to the invention comprise from 40 to 80% by mass of base oil with respect to the total mass of lubricant composition, preferably from 50 to 75% by mass, more preferably from 60 to 70%.

Other Additives

The lubricant compositions according to the invention can also contain all types of additives suitable for their use, in particular as engine oil, preferably for motor vehicle engines. These additives can be added individually, or in the form of additive packages, guaranteeing a certain level of performance to the lubricant compositions, as required, for example by the ACEA (European Automobile Manufacturers' Association). These are for example and non-limitatively:

Dispersants, such as for example succinimides, succinimide derivatives such as PIB (polyisobutene) succinimides, or Mannich bases, which ensure that the insoluble solid contaminants constituted by the by-products of oxidation which are formed when the engine oil is in service, are maintained in suspension and removed.

Antioxidants which slow down the degradation of the oils in service, degradation which can lead to the formation of deposits, the presence of sludge, or an increase in the viscosity of the oil. They act as radical inhibitors or hydroperoxide destroyers. Among the commonly used antioxidants, sterically hindered phenolic and amino-type antioxidants are found. Another class of antioxidants is that of oil-soluble copper compounds, for example copper thio- or dithiophosphates, copper salts of carboxylic acids, copper dithiocarbamates, sulphonates, phenates, acetylacetonates. Copper (I) and (II) salts of succinic acid or anhydride are also used.

Anti-wear additives which protect the friction surfaces by forming a protective film adsorbed on these surfaces. Various phosphorus-, sulphur-, nitrogen-, chlorine- and boron-containing compounds are also found in this category.

Friction modifiers such as MoDTC, fatty amines or the esters of fatty acids and polyols such as the esters of fatty acids and glycerol, in particular glycerol monooleate.

Detergents which are typically sulphonates, salicylates, naphthenates, phenates, overbased or neutral carboxylates.

And also anti-foaming agents, pour point depressants, corrosion inhibitors etc.

Another subject of the invention is a method for lubricating at least one mechanical part of an engine comprising at least one step in which said mechanical part is brought into contact with at least one lubricant composition as defined above. These parts are in particular the pistons. The method according to the invention makes it possible to simultaneously obtain satisfactory engine cleanliness and a reduction in the fuel consumption of said vehicles. All the characteristics and preferences for the lubricating composition shown also applies to the lubrication method of the invention.

Another subject of the present invention advantageously concerns the use of at least one polyalkylene glycol, which is a copolymer of butylene oxide and propylene oxide with the butylene oxide to propylene oxide mass ratio being a value of 3:1 to 1:3, preferably a value of 3:1 to 1:1 in a lubricant composition in order to improve engine cleanliness, without increasing the consumption of gasoline or diesel fuel, preferably in order to improve engine cleanliness by reducing the consumption of gasoline or diesel fuel, the polyalkylene glycol having the general formula (A):

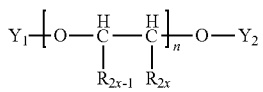

(A)

wherein $Y_1$ and $Y_2$ are, independently of each other, hydrogen, or an alkyl group having 1 to 30 carbon atoms, n represents an integer greater than or equal to 2, preferably less than 60, preferably ranging from 5 to 30, preferably ranging from 7 to 15, x represents one or more integers ranging from 1 to n, the $R_{2x-1}$ and $R_{2x}$ groups are, independently of each other, hydrogen, or hydrocarbon radicals, comprising from 1 to 2 carbon atoms, for at least one value of x, the sum of the numbers of carbon atoms in $R_{2x-1}$ and $R_{2x}$ is equal to 2.

All the characteristics and preferences for the lubricating composition shown applies equally to the use of at least one PAG of the invention according to the invention.

EXAMPLES

Example 1

Control compositions $T_1$ and the compositions $L_1$ and $L_2$ are prepared from:

a mixture of Group III base oils, an additive package comprising ZnDTP-type anti-wear additives, amino and phenolic anti-oxidants, succinimide-type dispersants, salicylate-type detergents, a molybdenum dithiocarbamate (MoDTC), a star-shaped hydrogenated styrene/isoprene (HIS) viscosity index improver polymer, with a mass Mw equal to 498700 (measured according to the standard ASTM D5296), with a mass Mn equal to 325900 (measured according to the standard ASTM D5296), with a polydispersity index equal to 1.5.

a polyalkylmethacrylate grafted with vinyl pyrrolidone units (PAMAd), with a mass Mw equal to 206900 (measured according to the standard ASTM D5296), with a mass Mn equal to 75320 (measured according to the standard ASTM D5296), with a polydispersity index equal to 2.7, a BO/PO (butylene oxide/propylene oxide) PAG having a mass ratio of 50/50, with a KV100 equal to 6 cSt (measured according to the standard ASTM D445) and with a molar mass equal to 750 g/mol measured according to the ASTM D4274 standard.

The proportions in percentage by mass of the different constituents are shown in Table I below. The proportions of the mixture of base oils and viscosity index improver polymer are adjusted so that the lubricant compositions $T_1$, $L_1$ and $L_2$ have equivalent viscosities, for a grade 5W-30.

TABLE I

| | $T_1$ | $L_1$ | $L_2$ |
|---|---|---|---|
| Mixture of Group III base oils | 82.7 | 74.9 | 52.7 |
| Additive package | 10.9 | 10.9 | 10.9 |
| MoDTC | 0.5 | 0.5 | 0.5 |
| HIS | 3.1 | 2.9 | 3.1 |
| PAMA | 2.8 | 2.8 | 2.8 |
| BO/PO PAG | — | 8 | 30 |
| Total | 100 | 100 | 100 |
| KV100 (1) | 9.87 | 9.82 | 9.82 |
| KV40 (1) | 48.39 | 48.75 | 49.71 |
| Viscosity index (VI) (2) | 192 | 194 | 189 |
| HTHS (3) | 2.99 | 3.04 | 3.07 |

(1) ISO 3104
(2) ISO 2909
(3) CEC L-036

The "Fuel Eco" gain of the lubricant compositions $T_1$, $L_1$ and $L_2$ is then measured on a running DW10C test engine. The conditions of this test are as follows:

Different engine speed and load conditions are scanned, during which the specific fuel consumption is measured. Running speed ranged from 1000 to 2400 rpm. Engine load ranged from 16 to 190 N.m. The engine oil and cooling liquid are stabilized at different temperatures (45° C., 60° C. and 75° C.) in order to ensure good repeatability of the measurement. For each point, the specific fuel consumption of the lubricant to be tested is compared with that of a 5W-30 reference oil. A weighted average makes it possible to express as a percentage the overall gain provided by the test lubricant with respect to the reference. The gains in terms of fuel consumption of the lubricant compositions $T_1$, $L_1$ and $L_2$ are given in Table II, expressed in % with respect to a reference oil of grade 5W-30.

The cleanliness of the engine is also measured by means of the Panel Coking Test (PCT) laboratory test under the following experimental conditions:

The lubricant to be tested flows over an inclined metal plate heated to 288° C. with a flow rate of 1 mL/min. A volume of oil of 100 mL is pumped over this plate in a closed circuit for a 24 h test period. At the end of the test, the plate is rinsed with a solvent and the varnish and carbon deposits on the flow surface are rated by means of a CRC (Coordinating Research Council) rating method. The result is expressed in the form of a score from 0 to 10 corresponding to the state of cleanliness of the plate.

The cleanliness of the engine is also measured by means of the TDi engine test according to the method CEC L-78-99 which measures in particular the cleanliness of the pistons. The cleanliness results for the lubricant compositions $T_1$, $L_1$ and $L_2$ are given in Table II.

TABLE II

| | $T_1$ | $L_1$ | $L_2$ |
|---|---|---|---|
| Weighted gain | 0.8 | 1.0 | 0.8 |
| PCT | 7.7 | 8.7 | 9.0 |
| CEC L-78-99 Tdi | 54 (reference 64) | 67 (reference 65) | — |

It is found that the addition of 8% of BO/PO PAG to a lubricant composition makes it possible to improve the gain in terms of fuel consumption and cleanliness, with iso-viscosity and for a smaller quantity of viscosity index improver polymer. The addition of 30% of BO/PO PAG to a lubricant composition makes it possible to improve engine cleanliness but with no change in gain in terms of fuel consumption.

Example 2

A control composition $T_2$ and compositions $C_1$ to $C_4$ are prepared from the same constituents as above, but with another polyalkylene glycol: a BO/PO PAG having a mass ratio of 50/50, KV100 equal to 4 cSt (measured according to the standard ASTM D445) and molar mass equal to 505 g/mol (measured according to the standard ASTM D4274). The proportions in percentage by mass of the different constituents are shown in Table III below. The proportions of the mixture of base oils and viscosity index improver polymer are adjusted so that the lubricant compositions $T_2$, $C_1$ to $C_4$ have equivalent viscosities, for a grade 5W-30.

The "Fuel Eco" gain of the lubricant compositions $T_2$, $C_1$ to $C_4$ is then measured on a driven DW10C test engine. The conditions of this test are as follows:

The engine is driven by means of a generator making it possible to impose a speed of rotation of between 750 and 3000 rpm while a torque sensor makes it possible to measure the friction torque generated by the movement of the engine parts. The engine oil and cooling liquid are stabilized at different temperatures (35° C., 50° C., 80° C. and 115° C.) in order to ensure good repeatability of the measurement. The friction torque induced by the test lubricant is compared for each speed and each temperature with the torque induced by the reference lubricant of grade 5W-30. The final result obtained by the test lubricant is obtained via the average of the gains on each operating point expressed with respect to the reference lubricant. A positive gain means that there is less friction in the engine and that the lubricant used makes it possible to reduce fuel consumption.

TABLE III

| | $T_2$ | $C_1$ | $C_2$ | $C_3$ | $C_4$ |
|---|---|---|---|---|---|
| Mixture of Group III base oils | 83.1 | 78.9 | 74.9 | 67.9 | 52.8 |
| Additive package | 10.9 | 10.9 | 10.9 | 10.9 | 10.9 |
| MoDTC | 0.5 | 0.5 | 0.5 | 0.5 | 0.5 |
| HSI | 2.8 | 2.9 | 2.9 | 2.9 | 2.9 |
| PAMA | 2.7 | 2.8 | 2.8 | 2.8 | 2.9 |
| PO/BO PAG | — | 4 | 8 | 15 | 30 |
| Total | 100 | 100 | 100 | 100 | 100 |
| KV100 (1) | 9.96 | 9.86 | 9.85 | 9.95 | 9.79 |
| KV40 (1) | 50.43 | 51.50 | 51.31 | 51.46 | 49.84 |
| Viscosity index (VI) (2) | 189 | 181 | 181 | 184 | 187 |
| HTHS (3) | 3.09 | 2.98 | 3.03 | 3.06 | 3.07 |
| Average FE gain | 2.2 | 2.4 | 3.1 | 2.1 | 1.9 |

(1) ISO 3104
(2) ISO 2909
(3) CEC L-036

It is found that the addition of 4% or 8% of BO/PO PAG makes it possible to improve the gain in terms of fuel consumption of these compositions. Quantities greater than 15% or 30% provide the same gain as the control composition.

The invention claimed is:

1. A lubricant composition for engines comprising, with respect to the total mass of the lubricant composition:

from 40 to 80% by mass of at least one base oil, from 1 to 15% by mass of at least one viscosity index improver polymer selected from styrene/olefin copolymers and polyacrylates, alone or in a mixture; and from 4 to 8% by mass of at least one polyalkylene glycol, which is a copolymer of butylene oxide and propylene oxide with the butylene oxide to propylene oxide mass ratio being a value of 1:1, the polyalkylene glycol having the general formula (A):

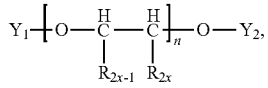

(A)

wherein $Y_1$ is hydrogen and $Y_2$ is hydrogen, or an alkyl group having 1 to 30 carbon atoms;

n represents an integer greater than or equal to 2;

x represents one or more integers ranging from 1 to n;

the $R_{2x-1}$ and $R_{2x}$ groups are, independently of each other, hydrogen, or hydrocarbon radicals, comprising from 1 to 2 carbon atoms; and for at least one value of x, the sum of the numbers of carbon atoms in $R_{2x-1}$ and $R_{2x}$ is equal to 2, the polyalkylene glycol having a kinematic viscosity at 100° C. measured according to the standard ASTM D445 of 4 cSt and a molar mass measured according to the standard ASTM D4274 of 505 g/mol.

2. The lubricant composition according to claim 1 further comprising at least one additive selected from the group consisting of the anti-wear additives, detergents, dispersants, anti-oxidants, friction modifiers alone or in a mixture.

3. The lubricant composition according to claim 1 comprising:

from 40 to 80% by mass of base oil, from 4 to 8% by mass of polyalkylene glycol, which is a copolymer of butylene oxide and propylene oxide with the butylene oxide to propylene oxide mass ratio being a value of 1:1, the polyalkylene glycol having the general formula (A):

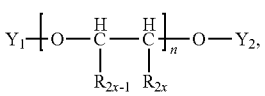

(A)

wherein $Y_1$ is hydrogen and $Y_2$ is hydrogen, or an alkyl group having 1 to 30 carbon atoms;

n represents an integer greater than or equal to 2;

x represents one or more integers ranging from 1 to n;

the $R_{2x-1}$ and $R_{2x}$ groups are, independently of each other, hydrogen, or hydrocarbon radicals, comprising from 1 to 2 carbon atoms; and for at least one value of x, the sum of the numbers of carbon atoms in $R_{2x-1}$ and $R_{2x}$ is equal to 2, and wherein the polyalkylene glycol has a kinematic viscosity at 100° C. measured according to the standard ASTM D445 of 4 cSt and a molar mass measured according to the standard ASTM D4274 of 505 g/mol, from 1 to 15% by mass of viscosity index improver polymer selected from styrene/olefin copolymers and polyacrylates, alone or in a mixture, from 1 to 15% by mass of additives chosen from the anti-wear additives, detergents, dispersants, anti-oxidants, friction modifiers alone or in a mixture, the sum of the constituents being equal to 100% and the percentage being expressed with respect to the total mass of lubricant composition.

4. A method comprising:

lubricating at least one mechanical part of an engine; and contacting the mechanical part with at least one lubricant composition comprising, with respect to the total mass of the lubricant composition:

from 40 to 80% by mass of at least one base oil, from 1 to 15% by mass of at least one viscosity index improver polymer selected from styrene from styrene/olefin copolymers and polyacrylates, alone or in a mixture, and from 4 to 8% by mass of at least one polyalkylene glycol, which is a copolymer of butylene oxide and propylene oxide with the butylene oxide to propylene oxide mass ratio being a value of 1:1, the polyalkylene glycol having the general formula (A):

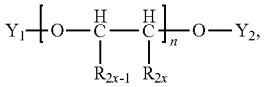

(A)

wherein $Y_1$ is hydrogen and $Y_2$ is hydrogen, or an alkyl group having 1 to 30 carbon atoms;

n represents an integer greater than or equal to 2;

x represents one or more integers ranging from 1 to n;

the $R_{2x-1}$ and $R_{2x}$ groups are, independently of each other, hydrogen, or hydrocarbon radicals, comprising from 1 to 2 carbon atoms; and for at least one value of x, the sum of the numbers of carbon atoms in $R_{2x-1}$ and $R_{2x}$ is equal to 2, the polyalkylene glycol having a kinematic viscosity at 100° C. measured according to the standard ASTM of 4 cSt and a molar mass measured according to the standard ASTM D4274 of 505 g/mol.

5. A method for improving engine cleanliness, without increasing the consumption of gasoline or diesel fuel, the method comprising:

providing at least one polyalkylene glycol, which is a copolymer of butylene oxide and propylene oxide with the butylene oxide to propylene oxide mass ratio being a value of 1:1, the polyalkylene glycol having the general formula (A):

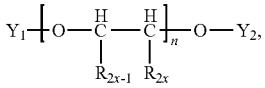

(A)

wherein $Y_1$ is hydrogen and $Y_2$ is hydrogen, or an alkyl group having 1 to 30 carbon atoms;

n represents an integer greater than or equal to 2;

x represents one or more integers ranging from 1 to n;

the $R_{2x-1}$ and $R_{2x}$ groups are, independently of each other, hydrogen, or hydrocarbon radicals, comprising from 1 to 2 carbon atoms;

for at least one value of x, the sum of the numbers of carbon atoms in $R_{2x-1}$ and $R_{2x}$ is equal to 2, the polyalkylene glycol having a kinematic viscosity at 100° C. measured according to the standard ASTM D445 of 4 cSt and a molar mass measured according to the standard ASTM D4274 of 505 g/mol;

adding from 4 to 8% by mass of the polyalkylene glycol of the general formula (A) in a lubricant composition which comprises from 40 to 80% by mass of at least one base oil and from 1 to 15% by mass of at least one viscosity index improver polymer selected from styrene/olefin copolymers and polyacrylates, alone or in a mixture, with respect to the total mass of the lubricant composition; and bringing into contact the lubricant composition obtained at the previous step with an engine.

* * * * *